US007798089B2

(12) United States Patent
McKeand

(10) Patent No.: US 7,798,089 B2
(45) Date of Patent: Sep. 21, 2010

(54) HINGED RADAR ARCH FOR MARINE VESSELS

(75) Inventor: Scott J. McKeand, Jeddo, MI (US)

(73) Assignee: Jay & Kay Mfg. LLC, Croswell, MI (US)

( * ) Notice: Subject to any disclaimer, the term of this patent is extended or adjusted under 35 U.S.C. 154(b) by 1 day.

(21) Appl. No.: 12/013,754

(22) Filed: Jan. 14, 2008

(65) Prior Publication Data

US 2009/0178604 A1 Jul. 16, 2009

(51) Int. Cl.
*B63B 17/00* (2006.01)

(52) U.S. Cl. ..... 114/364

(58) Field of Classification Search ..... 114/343, 114/354, 361, 364; D12/317; 296/120.1, 296/121

See application file for complete search history.

(56) References Cited

U.S. PATENT DOCUMENTS 3,471,876 A * 10/1969 Horiuchi et al. ..... 114/357
3,848,244 A * 11/1974 Young et al. ..... 340/665
4,694,773 A * 9/1987 Sparkes et al. ..... 114/354
4,951,594 A 8/1990 Feikema
4,955,313 A * 9/1990 Terry, III ..... 114/361
5,669,325 A 9/1997 Feikema
6,230,648 B1 * 5/2001 Davidson et al. ..... 114/363
6,927,743 B1 8/2005 Miller et al.
2006/0124045 A1 * 6/2006 Tucker et al. ..... 114/361

* cited by examiner

*Primary Examiner*—Daniel V Venne
(74) *Attorney, Agent, or Firm*—Brooks Kushman P.C.

(57) ABSTRACT

An arch assembly 10 for pivotably mounting on a boat 12, its method of manufacture, and deployment in use. The assembly 10 has an arch 14 with a generally inverted U-shaped configuration, a forward edge region 16 and an aft edge region 18, a laterally extending top portion 20 generally spanning the width of the boat 12 and a pair of downwardly extending leg portions 22, 24 for connection to the boat 12. Each leg portion 22, 24 has a lower basal edge 26, 28. A knuckle joint 30, 32 is provided adjacent to an edge region of the basal edge 26, 28 about which the arch assembly 10 may pivot from a secured upright position through intermediate positions 36 to an extended lower position 38 through a number (R) degrees of arcuate displacement. An anchoring subassembly 40, 41 provided adjacent to another region of the basal edge 26, 28 for releasably securing the arch assembly 10 to the boat 12. Means for influencing 42 pivotable movement 43 of the arch assembly 10 as it moves arcuately are also provided.

15 Claims, 5 Drawing Sheets

HINGED RADAR ARCH FOR MARINE VESSELS

BACKGROUND OF THE INVENTION

1. Field of the Invention

This invention relates generally to radar arches for marine vessels.

2. Background Art

Radar arches are often deployed on marine vessels. In use, such arches not only provide a mount for radar, but also for supporting a number of other devices and accessories. They include, for example, dinghy davits, a flag pole, TV antenna, loran antenna, transom light, wind generator, solar panel, backup VHF antenna, GPS antenna, and attachment points for a sunshade.

Preferably, from a visual viewpoint, the design of a radar arch should complement the lines of the boat, for example, by providing a curvature to the top of the arch and legs which support the arch in order to complement the transom and cabin lines. In some cases, the radar arch is anchored into the stern pulpit for additional stiffness. Conventionally, notably in fiberglass structures, stiffness has been provided by combining the stern pulpit and radar arch into a single rigid structure.

In practice, it may be desirable to have a radar arch that is high enough overhead in order to reduce radiation scatter in the cockpit.

Traditionally, the radar arch typically includes an arch member with a generally inverted U-shaped configuration that includes two side members that are joined by a transverse top portion which spans the vessel laterally. The downwardly extending side members supportably engage a base which may be the gunnel of the boat or its deck, or other superstructure.

Conventional high arches may not be sufficiently rigid and stable laterally. In rough seas, boat-to-wave impacts—especially at higher boat speeds—such arches may tend to result in vibration of the radar arch from side to side—"racking". The lower ends of the arch connected to the boat remain fixed while the upper portions of the arch are subjected to forces that urge lateral movement. This increases in proportion to height above the mounting surface. In general, the upper transverse portion of the radar arch may experience the greatest amount of movement.

This racking has several adverse consequences. First, the racking movement may be visually apparent. This may be viewed by the maritimer as inferior construction. Additionally, boat equipment mounted on and within the radar arch may suffer from excessive shaking. The radar transmitter mounted atop the radar thus may be most detrimentally affected as a result of the vibration. Moreover, should the racking of the radar arch become excessive and last for a sufficient amount of time, portions of the radar arch may begin to crack and fail.

Among the art considered in preparing this patent application are the following U.S. references: U.S. Pat. Nos. 6,927,743; 5,669,325; 4,951,594; and 4,694,773.

SUMMARY OF THE INVENTION

One aspect of this invention is directed to an arch assembly for pivotably mounting an arch on a boat. The arch has a generally inverted U-shaped configuration, a forward edge region and an aft edge region. The configuration includes a laterally extending top portion generally spanning across some if not the entire width of the boat. A pair of downwardly extending leg portions are hingedly connected to the boat. Each leg portion has a lower basal edge.

A knuckle joint is provided adjacent to an edge region of the basal edge about which the arch assembly may pivot from a secured position through intermediate positions to an extended position through a number (R) degrees of arcuate displacement. The edge region may be forward or aft, depending on the direction of pivoting movement.

Also provided is an anchoring subassembly provided adjacent to an aft edge region of the basal edge for releasably securing the arch assembly to the boat.

DETAILED DESCRIPTION OF THE PREFERRED EMBODIMENT(S)

Figure 1:
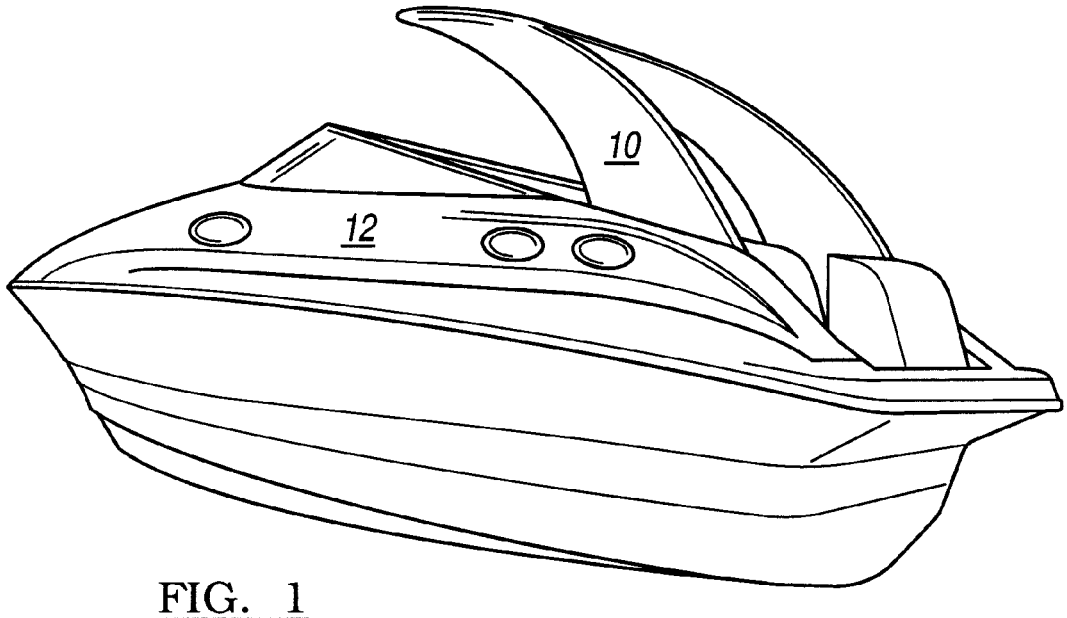
FIG. 1 is a perspective view which illustrates one embodiment of the invention in which an arch assembly is provided in a position that tilts forwardly in relation to a boat on which the arch assembly is hingedly mounted.

FIG. 1 depicts an arch assembly 10 that is pivotably mounted on a boat 12. In the configuration shown, the arch assembly 10 extends forwardly toward the bow of the boat, but the invention is not so limited. Optionally, at least part of the arch assembly 10 is hollow.

Figure 2:
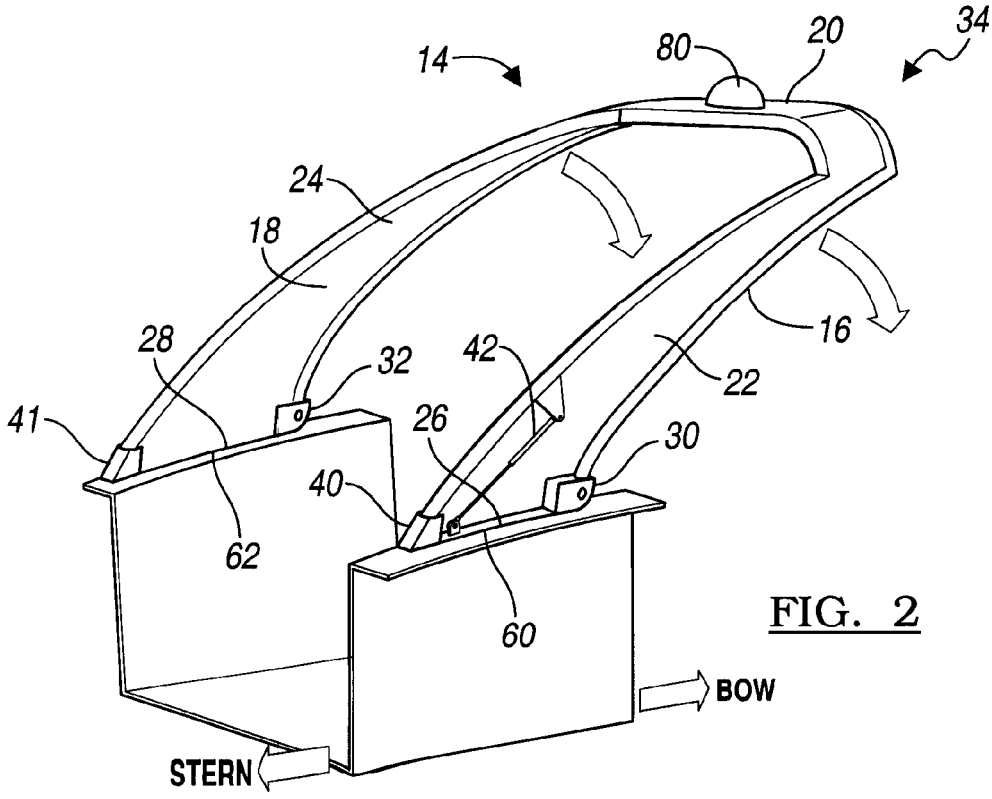
FIG. 2 is an additional perspective view of one embodiment of an arch assembly according to the invention.

Turning now to FIG. 2, there is depicted additional detail of one embodiment of the arch assembly 10. As shown, an arch structure 14 is defined as a generally inverted U-shaped configuration. In FIG. 2, for orientation, it is assumed that the bow of the boat lies on the right hand side, and the stern toward the left hand side of FIG. 2. With that frame of reference, the arch 14 has a forward edge region 16 and an aft edge region 18.

The configuration of the arch 14 includes a laterally extending top portion 20 that generally span across most, if not all, of the width of the boat. A pair of downwardly extending leg portions 22 (starboard), 24 (port) of the arch 14 are hingedly linked to the boat in a manner to be described. Each leg portion 22, 24 has a lower basal edge 26, 28. Preferably, the lower basal edges 26, 28 are configured so as to mate with a footing 60, 62 that is associated with the boat 12. In the embodiment depicted in FIG. 2, the footing 60, 62 is typified by gunnels which can generally be defined as an upper edge of the side of a boat. Such edges may, if desired, tilt outwardly and downwardly in relation to a longitudinal axis of the boat to allow water to drain outwardly in relation to the boat. Other examples of a footing include the deck of the boat, a side of the boat, a block, a plate, or another suitable superstructure.

Figure 3:
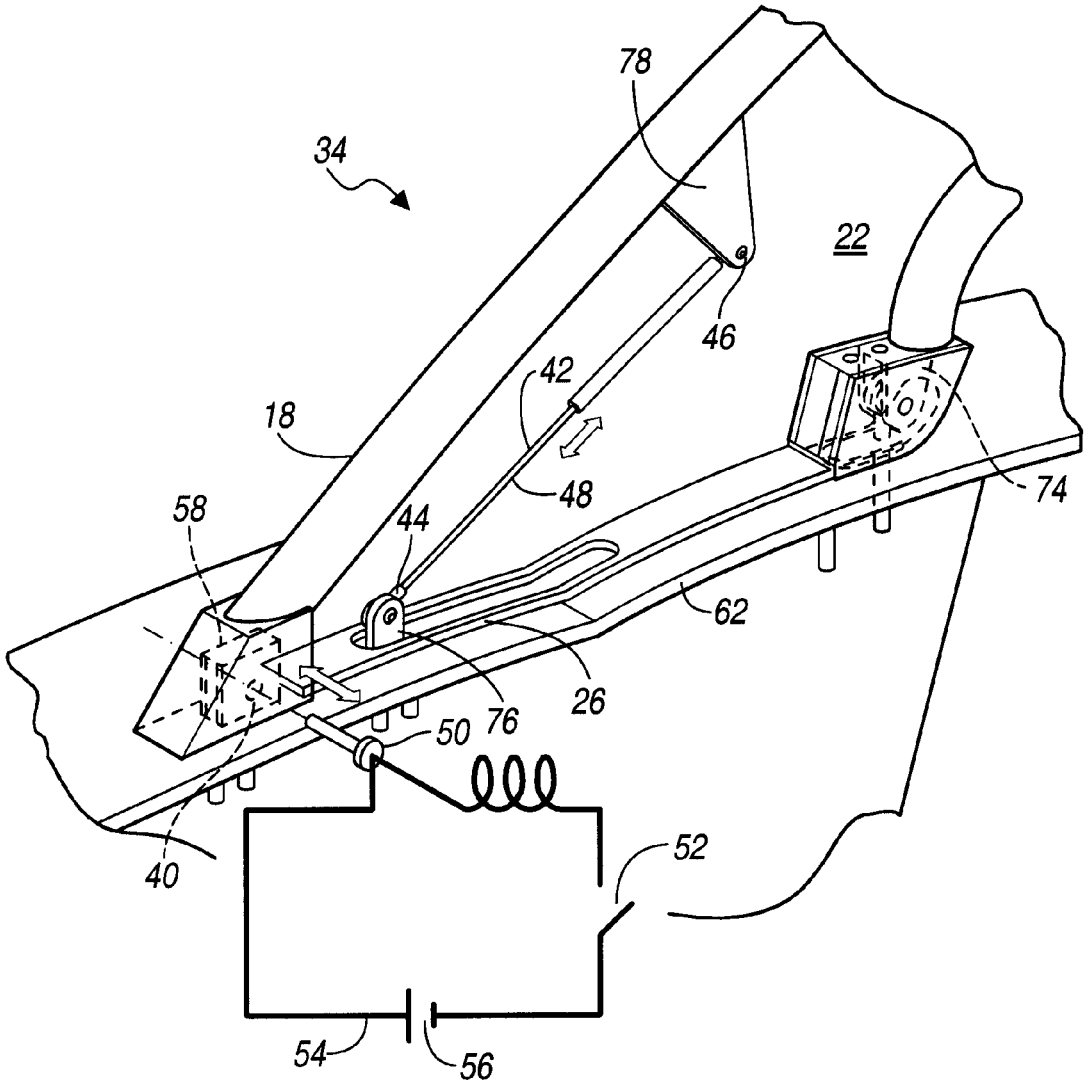
FIG. 3 is a more detailed view of portions of one embodiment of the invention that includes a means for influencing pivotable movement and an anchoring subassembly.
Figure 4:
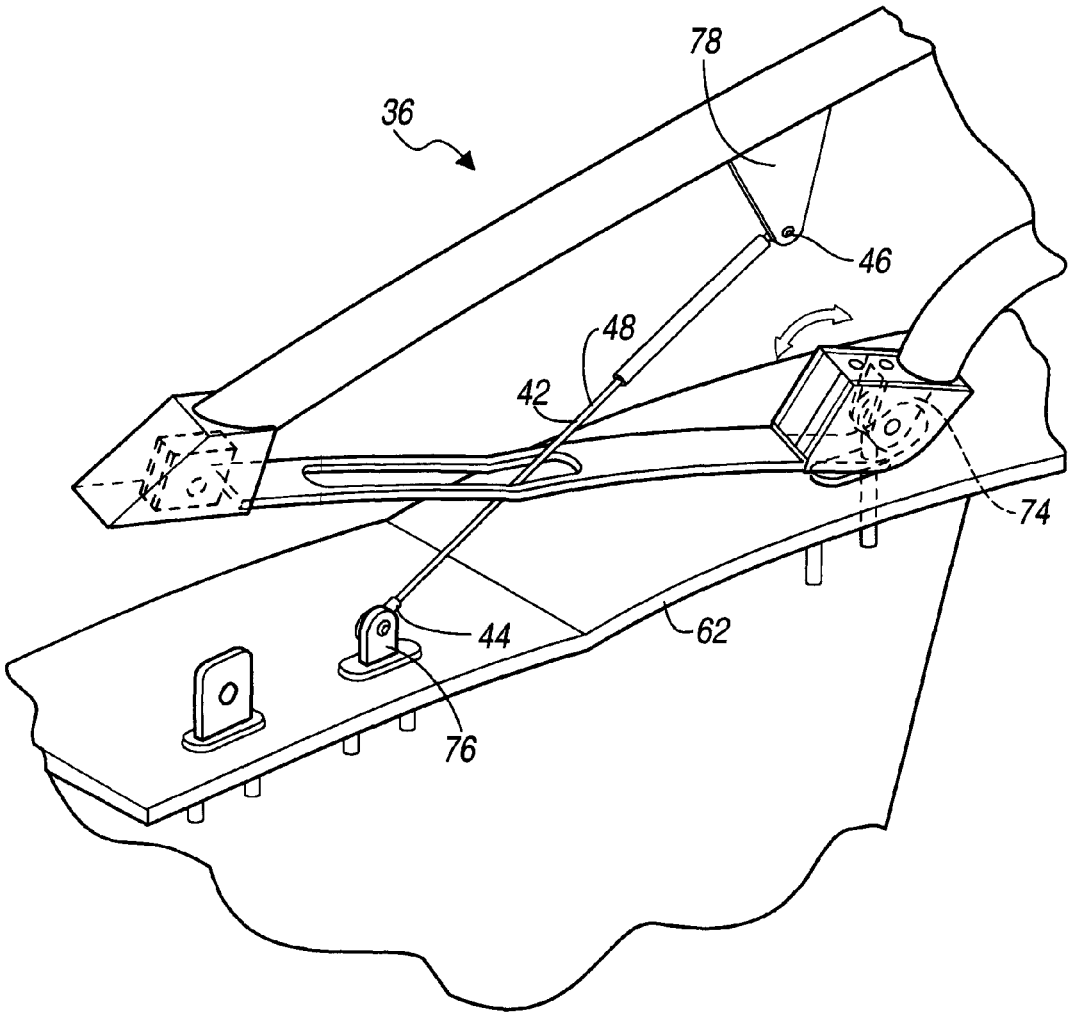
FIG. 4 depicts the arch assembly in an intermediate position.
Figure 5:
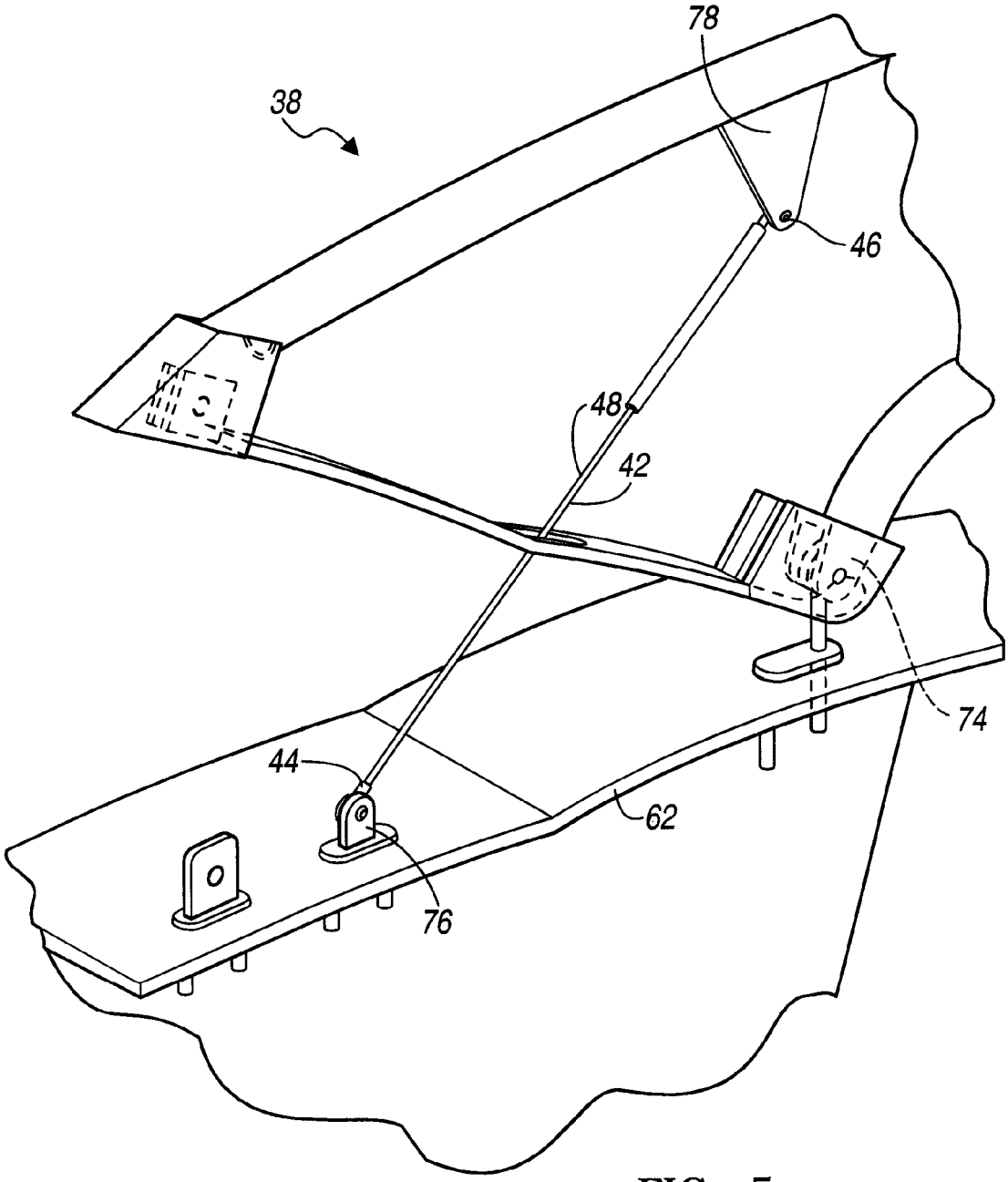
FIG. 5 depicts the arch assembly in an extended lowered position.

As suggested in FIGS. 3-5, one or more gunnels 60, 62 may be defined in a longitudinal direction by two sides of the boat 10 that are mutually inclined. In such configurations, it may be desirable for the lower basal edges 26, 28 to be so configured as to mate with non-parallel gunnels that also may have a shallow V-shaped upper surface.

Manufacturing tolerances are defined so as to accommodate a non-parallel relationship between the starboard and port gunnels with which the lower basal edges 26, 28 interface. Additionally, the disclosed invention can accommodate downwardly and outwardly sloping gunnels that permit the outboard draining of water.

Figure 6:
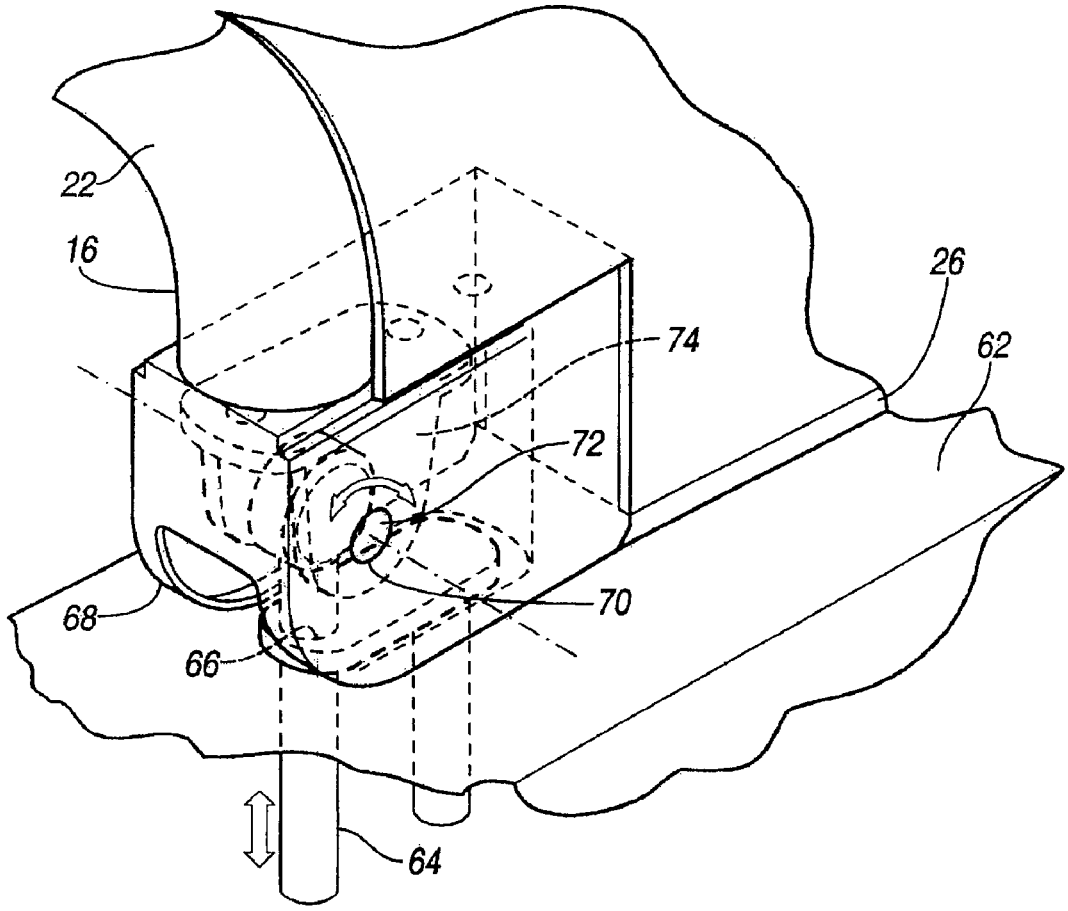
FIG. 6 depicts one knuckle joint in more detail.

Situated adjacent to a forward edge region 16 of the basal edge 26 is a knuckle joint 30, additional details of which are depicted in FIG. 6. It will be appreciated that one knuckle joint 30 is associated with the starboard leg portion 22, while another knuckle joint (not depicted in FIG. 6) 32 is associated with the port leg portion 24.

The knuckle joint assembly 30 include a post 64 that is mounted within a receiving orifice 66 that is defined in the gunnel 62. Extending upwardly from the post 64 is an eye 70 that receives a pin 72 which engages a saddle mounting 74 that is affixed to the starboard leg portion 22. It will be appreciated that the saddle mounting 74 is affixed to the leg portion 22 by any conventional means for affixing such as screws, bolts, and rivets. When the pin 72 links the saddle mounting 74 with the eye 70, and when an anchoring subassembly (to be described) at the aft portion of the lower basal edge 26 is released, the leg portion 22 and thus the arch 14 can be arcuately displaced about a curved engagement surface 68 as it rolls along or over the gunnel 62 such that there is clearance therebetween, between a secured upright position 34 (FIGS. 2, 3), intermediate positions 36 (FIG. 4) toward an extended lowered position 38 (FIG. 5).

For the purposes of this discussion, the knuckle joints 30, 32 in concert with other components to be discussed below permit the arch 14 to be arcuately displaced from the secured upright position toward the extended lowered position through a number (R) degrees. Preferably, $5 \leqq R \leqq 45°$. Since the requirement to pivot or swivel is usually toward the deck, this arcuate range generally falls between 20 and 45°.

Turning now to FIG. 3, there is depicted an anchoring subassembly 40 that is provided adjacent to an aft edge region 18 of the basal edge 26 of a leg portion 22. The anchoring subassembly 40 releasably secures the arch 14 to the boat 12. As suggested in FIG. 3, the actuator 50 (for example, a shackle, pin, or bolt) is operatively associated with the anchoring subassembly 40. In one embodiment, the actuator 50 takes the form of a shackle assembly that is mechanically linked to an aperture in the anchoring subassembly 40 so that when the shackle is engaged, the leg 22 is anchored in relation to the gunnel 62 of the boat 12.

In another embodiment, the actuator includes a switch or button means 52 for closing an electrical circuit 54 that includes a power source 56. In that embodiment, a solenoid-type arrangement is provided in which the actuator 50 is received within toroidal turns and may be moved inwardly or outwardly depending on whether the circuit 54 is closed or open. In one embodiment, the circuit will normally be open and the actuator 50 will be received by and engaged with the anchoring subassembly 40, thereby securing the leg 22. When the button means 52 is depressed and the circuit 54 is closed, the solenoid is energized and the actuator 50 will electromechanically be urged outwardly and away from the anchoring subassembly 40, thereby releasing the arch 14 in relation to the boat 12. Then, the arch 14 may pivot about the knuckle joint 30.

Alternatively, the actuator may include a swiveling clip, akin to that found in the latch that secures a trunk lid to a car. Optionally, the actuator may be influenced by an electrical signal.

Turning now to FIGS. 3-5, it will be appreciated that means 42 for influencing pivotable movement are provided. In one form, the means for influencing pivotable movement as depicted may be a gas spring. It will be appreciated that a helical spring may be provided in the alternative, or a cable segment or tether having a fixed length. The means 42 for influencing pivotable movement has a passive end region 44, an intermediate section 48, and an active end region 46. The passive end region 44 is pivotably hinged by a connection 76. The active end region 46 is pivotably connected to a mount on lug 78 that extends from an edge region 16 within the associated leg portion 22, 24 of the arch 14.

When the anchoring subassemblies 40, 41 are released, the means 42 for influencing pivotable movement can be calibrated so that only about ten pounds force of pressure is required to lift up the arch from its extended lower position 38 through intermediate positions 36 toward a secured upright position 34. The means for influencing pivotable movement also controls the rate of arcuate displacement through R°.

The means 42 for influencing pivotable movement could alternatively be embodied in an electrically actuated cylinder or a helical spring that in some cases could be totally enclosed in the arch, or in other cases be accommodated within the gunnel 62.

Transportation economies from the manufacturer to the retailer or customer are realized by deployment of the present invention. Packing economy and better use of space are permitted when the arch 14 can be deployed downwardly in relation to the boat 12. Additionally, deployment of the invention may be particularly useful if navigation requires passage under a low bridge or low roof of a boat house. Additionally, there are cost savings to the manufacturer and to the dealer that arise from use of the present invention because remounting a fixed arch is costly in comparison.

In some situations, it may be useful to releasably secure a line to an attachment feature 80 located onto the top portion 20 or a leg of the arch 14. Other accessories can be appended, such as a low line for a water skier or a fishing rod or line.

Thus, an alternate embodiment contemplates a "raked" back design wherein both legs 22, 24 of the arch member 14 are generally sloped rearwardly. However, such an arch member 14 may also be substantially upright or raked forwardly, although not specifically shown.

For ease of reference, following are the numerals and respective nomenclature that are used in this disclosure:

10 arch assembly
12 boat
14 arch
16 forward edge region
18 aft edge region
20 top portion
22 leg portion (starboard)
24 leg portion (port)
26 lower basal edge (22)
28 lower basal edge (24)
30 knuckle joint (22)
32 knuckle joint (24)
34 secured upright position
36 intermediate position
38 extended lowered position
40 anchoring subassembly
41 anchoring subassembly
42 means for influencing
43 pivotable movement
44 passive end region
46 active end region
48 intermediate section
50 actuator
52 button means

54 electrical circuit
56 power source
58 release mechanism
60 footing
62 gunnel
64 post
66 receiving orifice
68 curved engagement surface
70 eye
72 pin
74 saddle mounting
76 connection
78 lug
80 attachment feature While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An arch assembly for pivotably mounting on a boat, comprising:

a forwardly leaning arch with a generally inverted U-shaped configuration, a forward edge region and an aft edge region, the configuration including a laterally extending top portion generally extending across at least part of the boat;

a pair of downwardly extending leg portions for connection to the boat, each leg portion having a lower basal edge;

a footing associated with the boat to which the pair of downwardly extending leg portions are attached, the footing being selected from the group consisting of a plate, a deck, a gunnel, and a superstructure, the footing having an orientation selected from the group consisting of a gunnel that is tilted outwardly and downwardly to allow water to drain outwardly in relation to the boat a gunnel that is inclined to another gunnel, and a gunnel with a shallow v-shaped upper surface;

a knuckle joint with a curved surface positioned between the forward edge region of the arch and the lower basal edge about which the arch assembly may pivot in relation to the footing from a secured upright position through intermediate positions to an extended lowered position through a number (R) degrees of arcuate displacement; and an anchoring subassembly provided adjacent to an aft region of the lower basal edge for releasably securing the arch to the boat.

2. The arch assembly of claim 1, further comprising:

means for influencing pivotable movement of the forwardly leaning arch assembly as it moves arcuately from the secured position through intermediate positions to the extended position, the influencing means having a passive end region;

an intermediate section; and an active end region, the intermediate section extending between the active and passive regions, the passive end region being pivotably attached to the boat, and the active end region being rotatably attached to an edge region of a leg portion.

3. The arch assembly of claim 1, further comprising:

an actuator that is removably linked to the anchoring subassembly, the actuator including:

button means for closing an electrical circuit that includes a power source and a release mechanism that displaces the actuator so that it becomes disengaged from the anchoring subassembly, thereby releasing the anchoring subassembly when the circuit is closed so that the arch may pivot about the knuckle joint.

4. The arch assembly of claim 1, further comprising:

an actuator linked to the anchoring subassembly, the actuator including a shaft portion that may be displaced from an engagement to a disengagement position respectively for securing and releasing the anchoring subassembly so that the arch may be firmly attached to the boat or pivot about the knuckle joint.

5. The arch assembly of claim 1, wherein $5 \leqq R \leqq 45$ degrees.

6. An arch assembly for pivotably mounting on a boat comprising:

a forwardly leaning arch with a generally inverted U-shaped configuration, a forward edge region and an aft edge region, the configuration including a laterally extending top portion generally spanning the width of the boat;

a pair of downwardly extending leg portions for connection to the boat, each leg portion having a lower basal edge;

a footing associated with the boat to which the pair of downwardly extending leg portions are attached, the footing being selected from the group consisting of a plate, a deck, a gunnel, and a superstructure, the footing having an orientation selected from the group consisting of a gunnel that is tilted outwardly and downwardly to allow water to drain outwardly in relation to the boat a gunnel that is inclined to another gunnel, and a curved gunnel;

a knuckle joint including a curved surface positioned between the forward edge region of the arch and the lower basal edge about which the arch assembly may pivot in relation to the footing from a secured upright position through intermediate positions to an extended lowered position through a number (R) degrees of arcuate displacement so that a clearance is formed between the curved engagement surface and a gunnel of the boat;

an anchoring subassembly provided adjacent to an aft region of the lower basal edge for releasably securing the arch to the boat; and means for influencing pivotable movement of the arch assembly as it moves arcuately from the secured position through intermediate positions to the extended position, the influencing means having:

a passive end region;

an active end region; and an intermediate section that extends between the passive and active end regions, the passive end region being pivotably attached to the boat and the active end region being rotatably attached to an aft edge region of a leg portion.

7. The arch assembly of claim 6, further comprising:

an actuator linked to the anchoring subassembly, the actuator being displaceable from an engagement to a disengagement position respectively for securing and releasing the anchoring subassembly so that the arch may be firmly attached to the boat or be able to pivot about the knuckle joint.

8. An arch assembly for pivotably mounting on a boat comprising:

a forwardly leaning arch with a generally inverted U-shaped configuration, a forward edge region and an aft edge region, the configuration including a laterally extending top portion generally spanning the width of the boat;

a pair of downwardly extending leg portions for connection to the boat, each leg portion having a lower basal edge;

a knuckle joint including a curved engagement surface provided adjacent to a forward edge region of the basal edge about which the arch assembly may pivot from a secured upright position through intermediate positions to an extended lowered position through a number (R) degrees of arcuate displacement;

an anchoring subassembly provided adjacent to an aft edge region of the lower basal edge for releasably securing the arch to the boat; and means for influencing pivotable movement of the arch assembly as it moves about the curved engagement surface from the secured position through intermediate positions to the extended position, the influencing means having:

a passive end region;

an active end region; and an intermediate section that extends between the passive and active end regions, the passive end region being pivotably attached to the boat and the active end region being rotatably attached to an aft edge region of a leg portion;

wherein the knuckle joint comprises:

a post that is mounted within a receiving orifice that is defined in a footing, the footing being selected from the group consisting of a plate, a deck, a gunnel, and a superstructure, the footing having an orientation selected from the group consisting of a tilted gunnel, a gunnel that is inclined to another gunnel, and a gunnel with a shallow v-shaped upper surface;

an eye disposed at one end of the post;

a pin that may be slidingly received by the eye;

a saddle mounting affixed to the leg portion, the saddle mounting being affixed to the leg portion by means for affixing, so that when the pin links the saddle mounting with the eye, and when an anchoring subassembly associated with the lower basal edge is released, the leg portion and thus the arch can be arcuately displaced as a curved engagement surface moves in relation to the footing between a secured position through intermediate positions toward an extended position.

9. The arch assembly of claim 6, further including a lug that extends from a leading edge region of an associated leg portion, the active end region of the means for influencing being pivotably connected to the lug.

10. The arch assembly of claim 6, further including an attachment feature attached to the arch for releasably securing an accessory.

11. The arch and assembly of claim 6, wherein the means for influencing is selected from the group consisting of a gas spring, a helical spring, a tether, a cable, an electric actuator, and combinations thereof.

12. The arch assembly of claim 6, wherein the laterally extending top portion includes a hollow portion.

13. A method for using an arch assembly for pivotably mounting on a boat comprising the steps of:

providing a forwardly leaning arch with a generally inverted U-shaped configuration, a forward edge region and an aft edge region, a laterally extending top portion generally spanning the width of the boat and a pair of downwardly extending leg portions for connection to footings associated with the boat, each leg portion having a lower basal edge;

locating a knuckle joint with a curved engagement surface adjacent to an edge region of the basal edge about which the arch assembly may pivot regardless of the orientation of the footing from a secured upright position through intermediate positions to an extended lowered position through a number (R) degrees of arcuate displacement;

mounting an anchoring subassembly adjacent to the basal edge for releasably securing the arch to the boat; and positioning means for influencing pivotable movement of the arch assembly as it moves arcuately from the secured position through intermediate positions to the extended position, the influencing means having a passive end region; an active end region; and an intermediate section that extends between the passive and active end regions, the passive end region being pivotably attached to the boat and the active end region being rotatably attached to a leg portion.

14. The method of claim 13, further comprising the step of:

moving an actuator linked to the anchoring subassembly, the actuator including a shaft portion that may be displaced from an engagement to a disengagement position respectively for securing and releasing the anchoring subassembly so that the arch may be firmly attached to the boat or pivot about the knuckle joint.

15. The arch assembly of claim 1, further comprising:

an actuator that is removably linked to the anchoring subassembly, the actuator including:

a button for closing an electrical circuit that includes a power source and a release mechanism that displaces the actuator so that it becomes disengaged from the anchoring subassembly, thereby releasing the anchoring subassembly when the circuit is closed so that the arch may pivot about the knuckle joint.

* * * * *

UNITED STATES PATENT AND TRADEMARK OFFICE

CERTIFICATE OF CORRECTION

PATENT NO. : 7,798,089 B2
APPLICATION NO. : 12/013754
DATED : September 21, 2010
INVENTOR(S) : Scott J. McKeand It is certified that error appears in the above-identified patent and that said Letters Patent is hereby corrected as shown below:

Column 5, Line 38, Claim 1:

After "boat" and before "a" insert -- , --.

Column 6, Line 29, Claim 6:

After "boat" and before "a" insert -- , --.

Signed and Sealed this

Thirtieth Day of November, 2010

David J. Kappos

David J. Kappos
*Director of the United States Patent and Trademark Office*